US011398667B2

(12) United States Patent
Liao et al.

(10) Patent No.: US 11,398,667 B2
(45) Date of Patent: Jul. 26, 2022

(54) ELECTRONIC DEVICE

(71) Applicant: WISTRON NEWEB CORPORATION, Hsinchu (TW)

(72) Inventors: Tzu-Hao Liao, Hsinchu (TW); Cheng-Da Yang, Hsinchu (TW)

(73) Assignee: WISTRON NEWEB CORPORATION, Hsinchu (TW)

( * ) Notice: Subject to any disclaimer, the term of this patent is extended or adjusted under 35 U.S.C. 154(b) by 0 days.

(21) Appl. No.: 16/923,151

(22) Filed: Jul. 8, 2020

(65) Prior Publication Data

US 2021/0028533 A1 Jan. 28, 2021

Related U.S. Application Data

(60) Provisional application No. 62/877,850, filed on Jul. 24, 2019.

(30) Foreign Application Priority Data

May 11, 2020 (TW) ..... 109115506

(51) Int. Cl.
*H01Q 1/22* (2006.01)
*H01Q 5/307* (2015.01)
*H01Q 1/48* (2006.01)

(52) U.S. Cl.
CPC ..... *H01Q 1/2266* (2013.01); *H01Q 1/48* (2013.01); *H01Q 5/307* (2015.01)

(58) Field of Classification Search
CPC ..... H01Q 1/22–1/24; H01Q 5/30
See application file for complete search history.

(56) References Cited

U.S. PATENT DOCUMENTS 4,218,682 A * 8/1980 Frosch ..... H01Q 5/40 343/700 MS
7,228,112 B2 * 6/2007 Ota ..... H01Q 21/28 455/90.3
7,683,840 B2 3/2010 Lin et al.
8,232,926 B2 * 7/2012 Iwai ..... H01Q 9/16 343/702
2011/0006953 A1 1/2011 Chiang et al.
(Continued)

FOREIGN PATENT DOCUMENTS

TW 200805777 A 1/2008

*Primary Examiner* — Hasan Islam
(74) *Attorney, Agent, or Firm* — McClure, Qualey & Rodack, LLP

(57) ABSTRACT

An electronic device includes a first radiation element, a second radiation element, a grounding element, and a feeding element. The first radiation element includes a first radiation portion and a feeding portion electrically connected to the first radiation portion. The second radiation element is coupled to the first radiation element and separate from the first radiation element. The grounding element is electrically connected to the second radiation element. The feeding element includes a feeding end and a grounding end. The feeding end is electrically connected to the feeding portion, and the grounding end is electrically connected to the grounding element. An operating frequency band generated by the first radiation element is greater than an operating frequency band generated by the second radiation element.

14 Claims, 12 Drawing Sheets

(56) References Cited

U.S. PATENT DOCUMENTS

| | | | | |
|---|---|---|---|---|
| 2013/0050057 | A1* | 2/2013 | Hayashi | H01Q 1/38 343/893 |
| 2014/0085164 | A1* | 3/2014 | Kashiwagi | H01Q 9/42 343/893 |
| 2016/0164166 | A1* | 6/2016 | Lee | H01Q 5/371 343/702 |
| 2018/0366813 | A1* | 12/2018 | Kim | H01Q 21/00 |
| 2020/0304185 | A1* | 9/2020 | Tsai | G06F 1/1618 |
| 2021/0218137 | A1* | 7/2021 | Zhu | H01Q 1/521 |

* cited by examiner

ELECTRONIC DEVICE

CROSS-REFERENCE TO RELATED PATENT APPLICATION

This application claims priority to the U.S. Provisional Patent Application Ser. No. 62/877,850, filed on Jul. 24, 2019, which application is incorporated herein by reference in its entirety.

This application claims the benefit of priority to Taiwan Patent Application No. 109115506, filed on May 11, 2020. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to an electronic device, and more particularly to an electronic device capable of transmitting and receiving radio frequency signals.

BACKGROUND OF THE DISCLOSURE

For the sake of aesthetics and robustness, an exterior casing of an electronic device is mostly made of a metal material. However, due to the characteristics of a metal casing, antenna modules within the electronic device are easily negatively affected, thereby decreasing a communication quality of a mobile device.

Therefore, how the communication quality of the electronic device can be improved and the aforementioned deficiencies can be overcome through reworking of the structural design, has become an important issue to be solved in this technical field.

SUMMARY OF THE DISCLOSURE

In response to the above-referenced technical inadequacies, the present disclosure provides an electronic device.

In one aspect, the present disclosure provides an electronic device including a first radiation element, a second radiation element, a grounding element and a feeding element. The first radiation element includes a first radiation portion and a feeding portion electrically connected to the first radiation portion. The second radiation element is coupled to the first radiation element and is separate from the first radiation element. The grounding element is electrically connected to the second radiation element. The feeding element includes a feeding end and a grounding end, the feeding end is electrically connected to the feeding portion, and the grounding end is electrically connected to the grounding element. An operating frequency band generated by the first radiation element is greater than an operating frequency band generated by the second radiation element.

Therefore, by virtue of "the second radiation element is coupled to the first radiation element and is separate from the first radiation element", the first radiation element and the second radiation element of the electronic device of the present disclosure respectively generates two different operating frequency bands, and the operating frequency band generated by the first radiation element is greater than the operating frequency band generated by the second radiation element.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
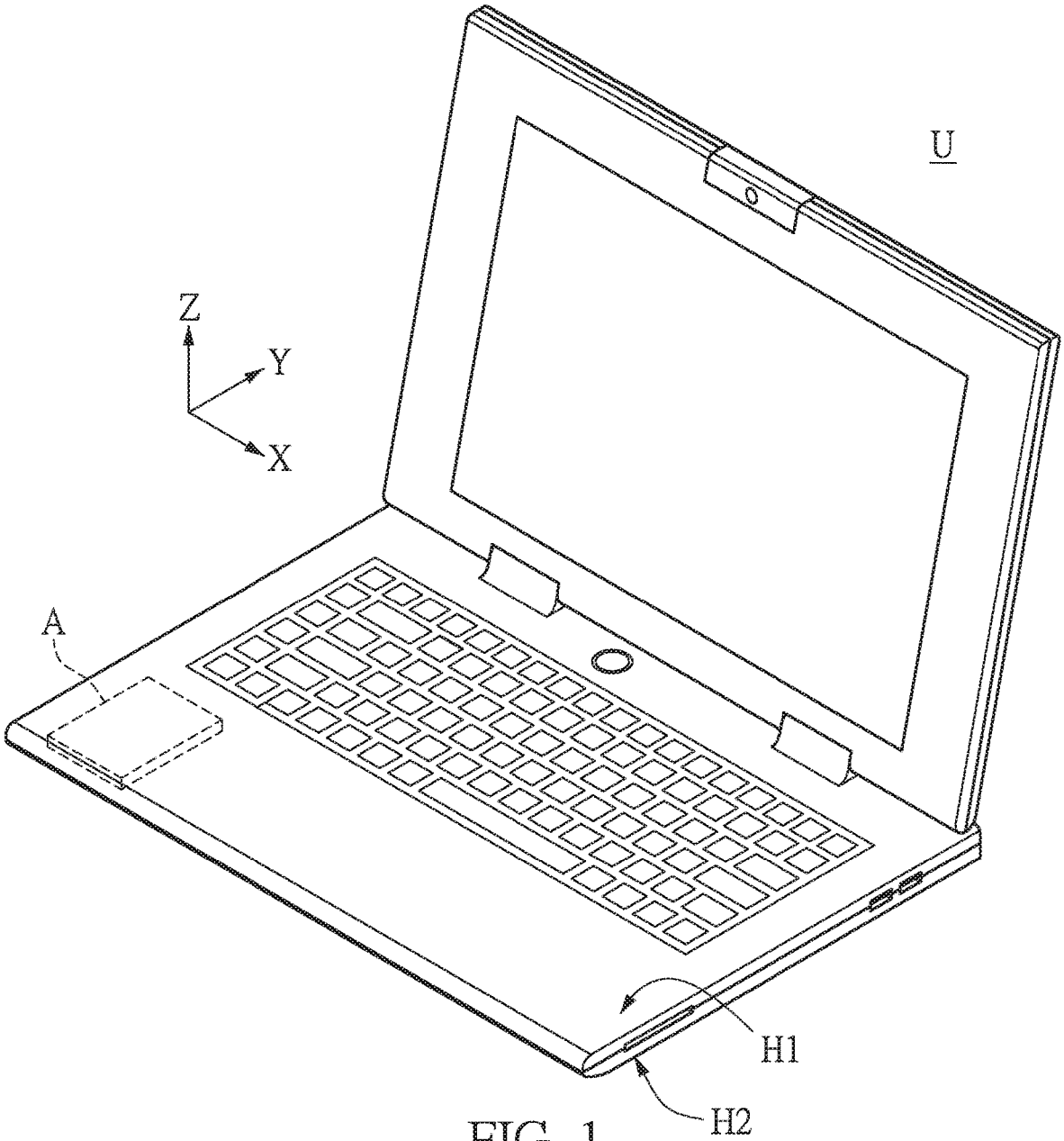
FIG. 1 is a schematic perspective view of an electronic device according to a first embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like. Moreover, it should be particularly noted that "connect" in the entire present disclosure may refer to a direct connection or an indirect connection between two components, but the present disclosure is not limited thereto. In addition, it should be particularly noted that "couple" in the entire present disclosure may refer to a non-physical connection between two components, and electric field energy generated by a current of a component excites electric field energy of another component.

First Embodiment

Figure 2:
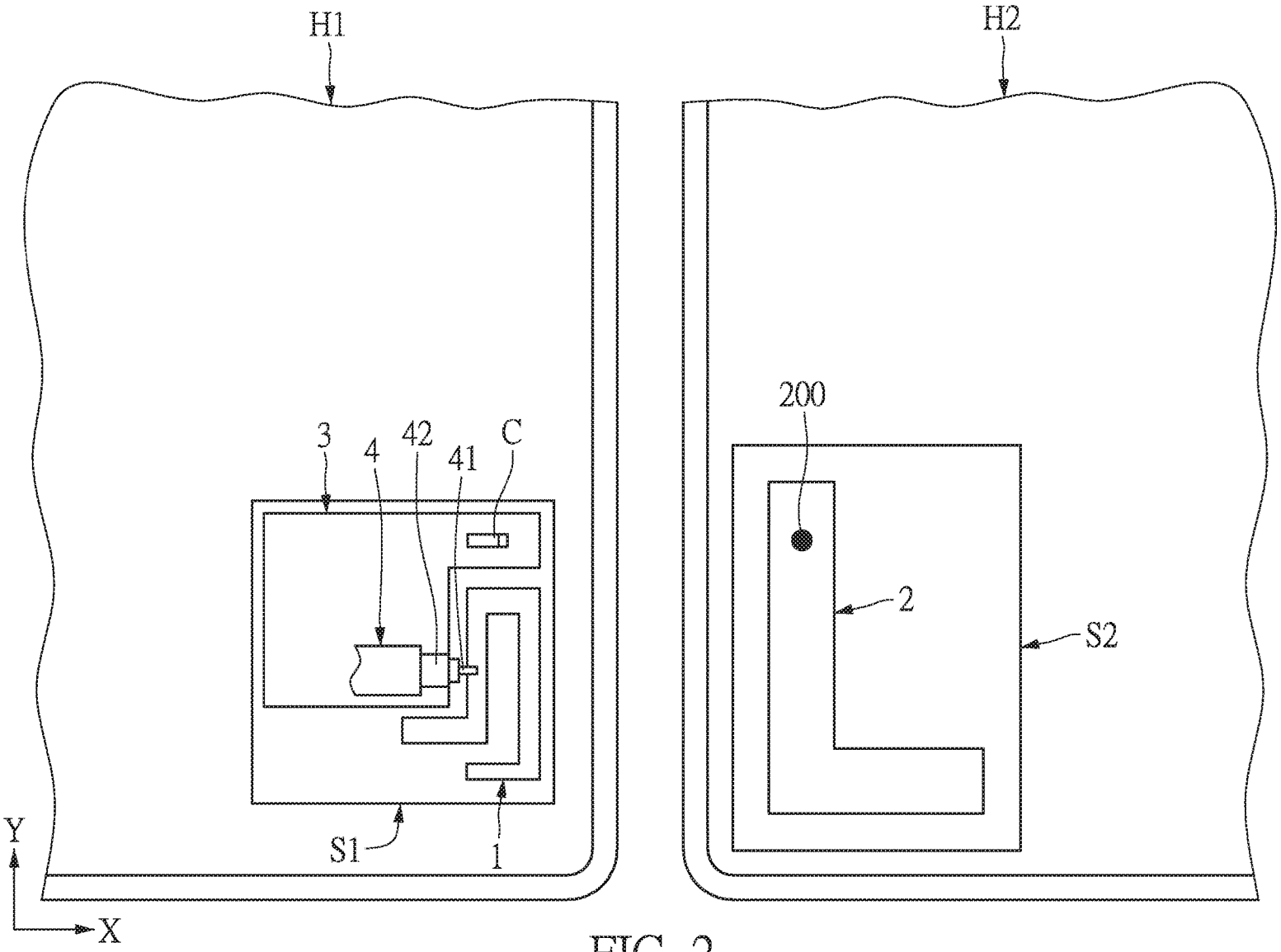
FIG. 2 is an exploded view of the electronic device according to the first embodiment of the present disclosure.

Firstly, referring to FIG. 1 and FIG. 2, a first embodiment of the present disclosure provides an electronic device U capable of receiving and transmitting radio frequency (RF) signals. For example, the electronic device U may be a smart phone, a tablet computer, or a notebook computer, but the present disclosure is not limited thereto. In addition, the electronic device U generates a first operating frequency band and a second operating frequency band, and the first operating frequency band is greater than the second operating frequency band. Specifically, a center frequency of the first operating frequency band is greater than a center frequency of the second operating frequency band. For example, the electronic device U generates an operating frequency band of between 1710 MHz and 2690 MHz (the first operating frequency band) and an operating frequency band of between 698 MHz and 960 MHz (the second operating frequency band), but the present disclosure is not limited thereto.

In the present disclosure, as an example, the electronic device U is a notebook computer. The electronic device U includes a first radiation element 1, a second radiation element 2, a grounding element 3 and a feeding element 4, and the first radiation element 1, the second radiation element 2, the grounding element 3 and the feeding element 4 forms an antenna module A disposed in the electronic device U and is used to receive and transmit RF signals. The electronic device U further includes a first substrate S1, a second substrate S2, a first casing H1 and a second casing H2. The first casing H1 may be a palm rest of a notebook computer, and the second casing H2 may be a bottom cover of a notebook computer, in other words, FIG. 2 is a top view of the first casing H1 when being flipped open to the left. It is worth noting that, in other implementations where the electronic device U is a smart phone or a tablet computer, the first casing H1 and the second casing H2 may respectively be two corresponding exterior casings of the smart phone or the tablet computer.

Figure 3:
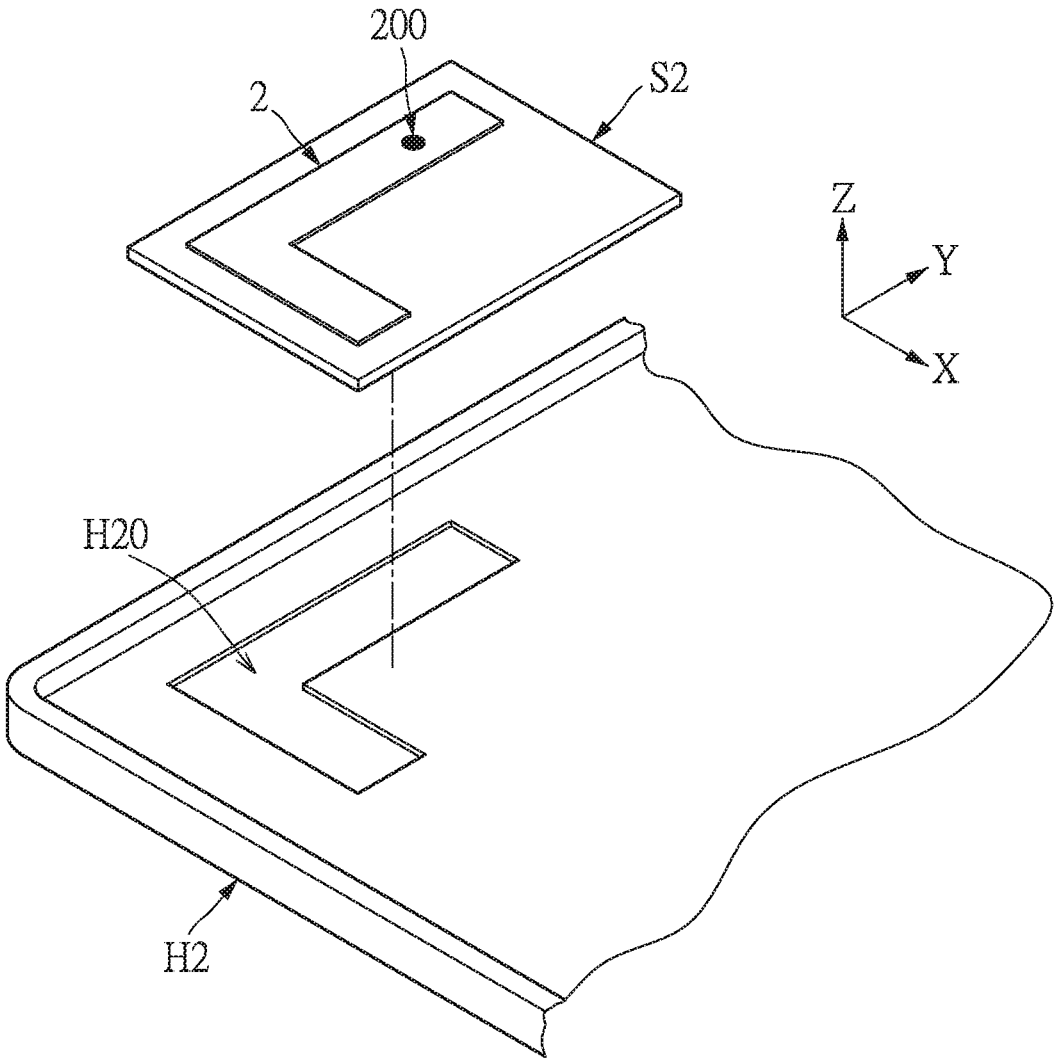
FIG. 3 is an exploded perspective view of a portion of the electronic device according to the first embodiment of the present disclosure.
Figure 4:
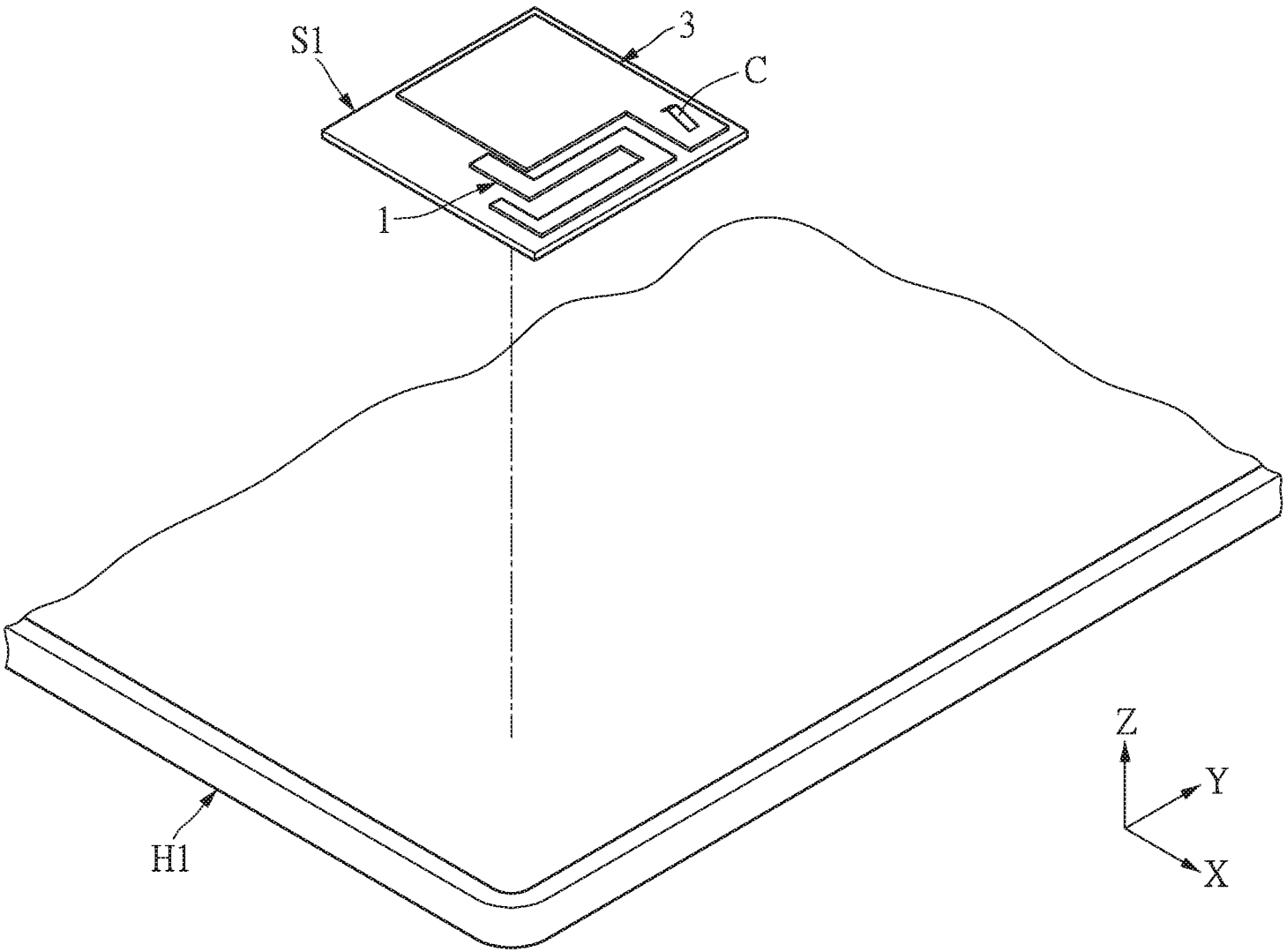
FIG. 4 is an exploded perspective view of another portion of the electronic device according to the first embodiment of the present disclosure.
Figure 7:
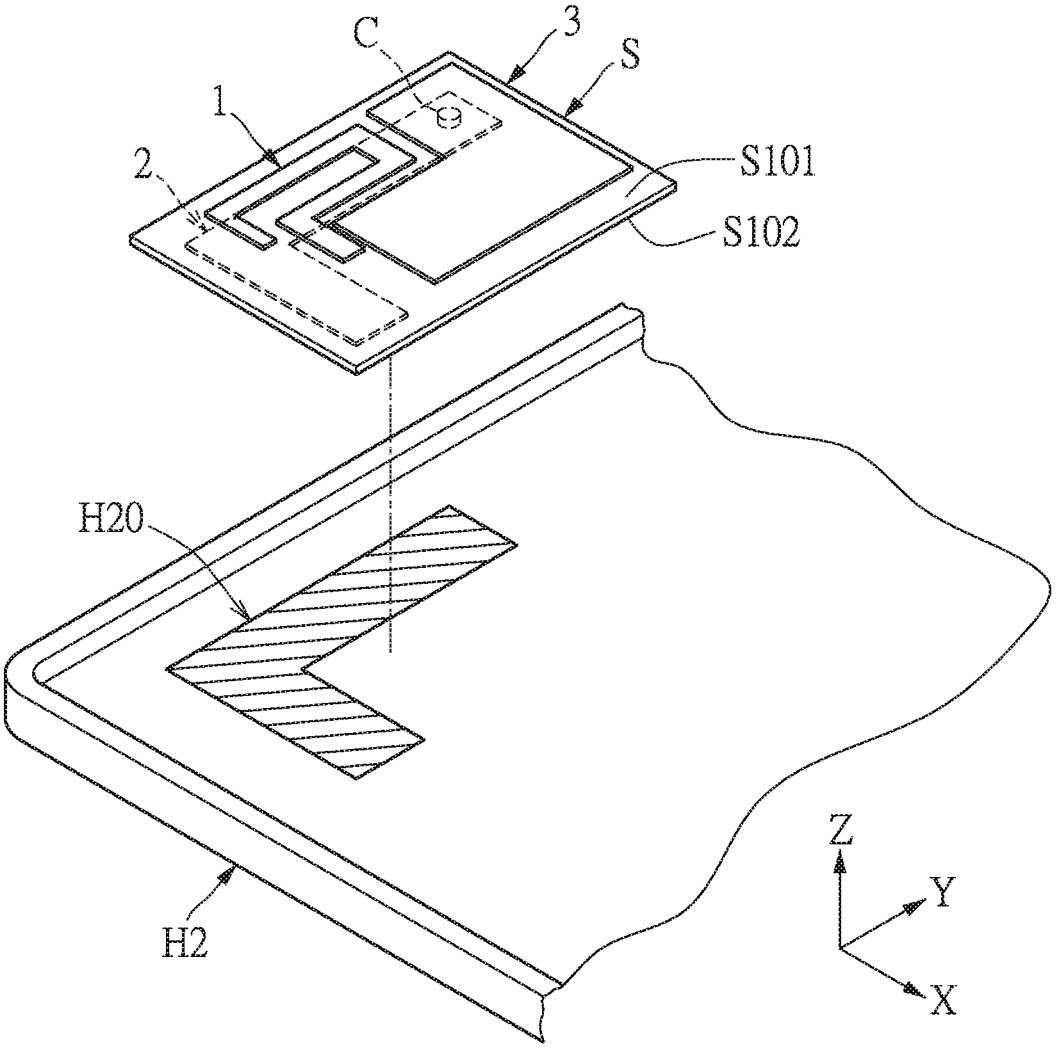
FIG. 7 is an exploded perspective view of another implementation of the electronic device according to the first embodiment of the present disclosure.

Referring to FIG. 1 and FIG. 2, and in conjunction with FIG. 3 and FIG. 4, in the first embodiment, the first radiation element 1 is disposed adjacent to the first casing H1, and the second radiation element 2 is disposed adjacent to the second casing H2, in other words, the first radiation element 1 is disposed closer to the first casing H1 than the second radiation element 2 is, and the second radiation element 2 is disposed closer to the second casing H2 than the first radiation element 1 is. In addition, for example, the first substrate S1 is disposed on the first casing H1, the second substrate S2 is disposed on the second casing H2, the first radiation element 1 is disposed on the first substrate S1, and the second radiation element 2 is disposed on the second substrate S2. It should be noted that, although in the first embodiment of the present disclosure, structures of the first radiation element 1 and the second radiation element 2 are exemplified as being respectively disposed on the first substrate S1 and the second substrate S2, such that the first radiation element 1 and the second radiation element 2 are respectively adjacent to the first casing H1 and the second casing H2, in other embodiments, the first radiation element 1 and the second radiation element 2 may be respectively disposed on two opposite surfaces of a same substrate S (as shown in FIG. 7). The present disclosure is not limited to the manner of disposing the first radiation element 1 and the second radiation element 2 between the first casing H1 and the second casing H2. It should be noted that, in one of the implementations, the first radiation element 1 mainly generates an operating frequency band of between 1710 MHz and 2690 MHz, and the second radiation element 2 mainly generates an operating frequency band of between 698 MHz and 960 MHz, but the present disclosure is not limited thereto.

For example, the material of the first casing H1 may be metal, the material of the second casing H2 may also be metal, and when the material of the first casing H1 is metal, the grounding element 3 may be electrically connected to the first casing H1. It should be particularly noted that, the second casing H2 has at least a non-metal area H20 corresponding to the contours of the second radiation element 2. Further, the orthogonal projection of the second radiation element 2 on the second casing H2 at least partially overlaps with the non-metal area H20 such that the second casing H2 made of metal is prevented from negatively affecting the radiation efficiency of the second radiation element 2. Preferably, in one of the implementations, an area of the orthogonal projection of the second radiation element 2 on the second casing H2 is less than an area of the non-metal area H20, and the orthogonal projection of the second radiation element 2 on the second casing H2 completely overlaps on the non-metal area H20. In addition, referring to FIG. 3, the non-metal area H20 may be a groove on the second casing H2, whereas in other implementations the non-metal area H20 may be formed by filling a non-metal element (as shown in FIG. 7), such as plastic, in the groove on the second casing H2, but the present disclosure is not limited in a manner that the non-metal area H20 is formed on the second casing H2.

It should be noted that, in the present disclosure, the material of the first casing H1 and the second casing H2 is exemplified as being metal, the orthogonal projection of the first radiation element 1 on the first casing H1 and a metal area (not labeled in the figures) on the first casing H1 at least partially or completely overlap with each other, the orthogonal projection of the second radiation element 2 on the first casing H1 and a metal area (not labeled in the figures) on the first casing H1 at least partially or completely overlap with each other, and the orthogonal projection of the second radiation element 2 on the second casing H2 at least partially overlaps with the non-metal area H20 on the second casing H2. In other implementations, the material of the second casing H2 may be non-metal. In other words, the present disclosure may be applied to an electronic device U; wherein the material of at least one of the first casing H1 and the second casing H2 is metal, the first radiation element 1 that generates a greater operating frequency band is closer to the first casing H1 made of metal material than the second radiation element 2 that generates a lesser operating frequency band, and the second radiation element 2 that generates a lesser operating frequency band is closer to the second casing H2 made of metal or non-metal material than the first radiation element 1 that generates a greater operating frequency band, such that the overall radiation efficiency is improved. It should be noted that, regardless of whether the material of the second casing H2 is metal or non-metal, the second casing H2 has at least the non-metal area H20 corresponding to the contours of the second radiation element 2.

Figure 5:
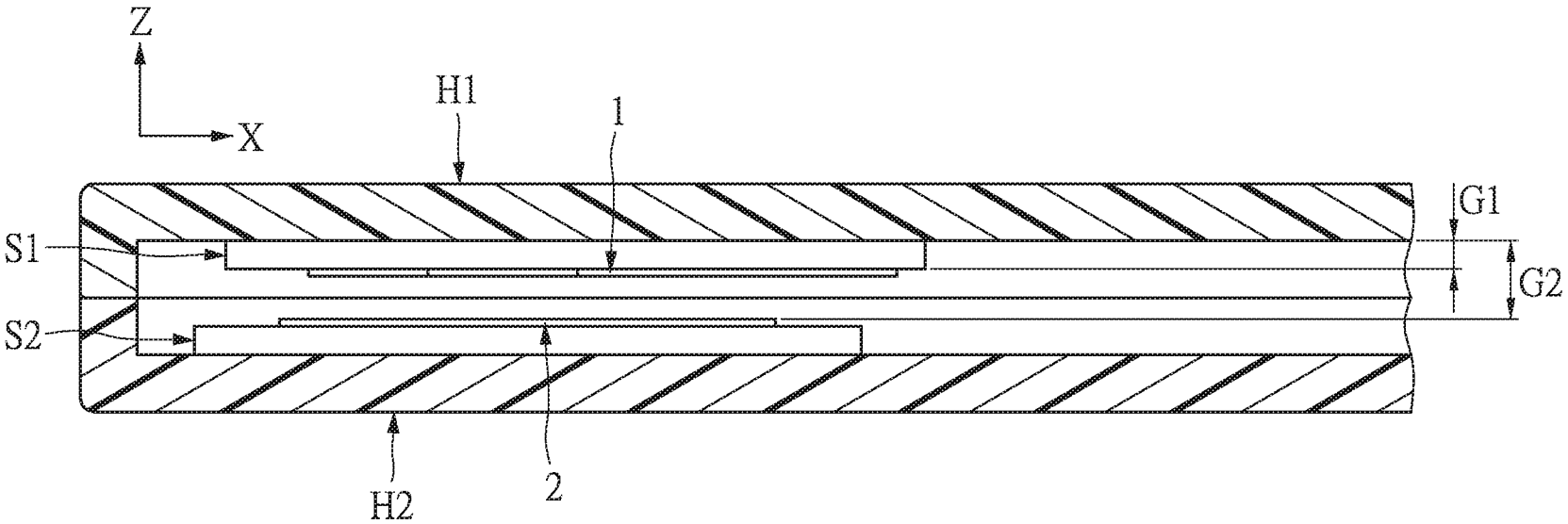
FIG. 5 is a sectional view of a portion of the electronic device according to the first embodiment of the present disclosure.

Referring to FIG. 1 and FIG. 2, in conjunction with FIG. 5, when the first casing H1 and the second casing H2 are stacked together as shown in FIG. 1, the first casing H1 and the second casing H2 may have a distance there-between, and the first substrate S1, the second substrate S2, the first radiation element 1 and the second radiation element 2 are disposed between the first casing H1 and the second casing H2, and are positioned at a corner between the first casing H1 and the second casing H2. In other words, the first casing H1 and the second casing H2 have an accommodating space there-between (not labeled in the figures), and the first substrate S1, the second substrate S2, the first radiation element 1 and the second radiation element 2 are disposed in the accommodating space. Referring to FIG. 5, in the first embodiment, the first radiation element 1 and the first casing H1 may have a first predetermined distance G1 greater than 0.1 mm there-between, and the second radiation element 2 and the first casing H1 may have a second predetermined distance G2 greater than 5 mm there-between. Since the material of at least one of the first casing H1 and the second casing H2 is metal, a structure of the first radiation element 1 and the first casing H1 having a first predetermined distance G1 and the second radiation element 2 and the first casing H1 having a second predetermined distance G2 may be used to prevent the first casing H1 and/or second casing H2 from negatively affecting the radiation efficiency of the first radiation element 1 and the second radiation element 2.

Figure 6:
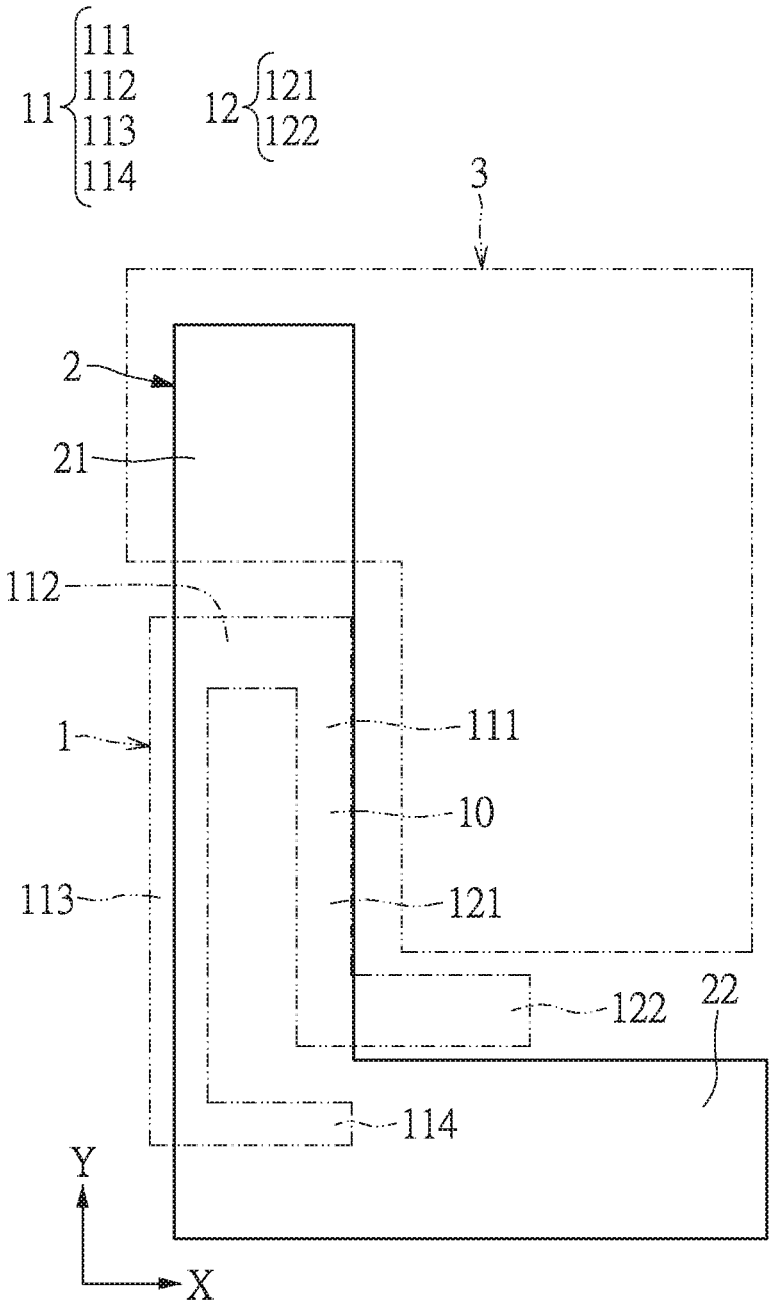
FIG. 6 is a schematic view showing a first radiation element, a second radiation element, and a grounding element in a state of use, with a first casing and a second casing of the electronic device being stacked together, according to the first embodiment of the present disclosure.

Reference is made to FIG. 1 to FIG. 4, in conjunction with FIG. 6. It should be noted that, in order to clearly illustrate a use state of the first radiation element 1, the second radiation element 2 and the grounding element 3 when the first casing H1 and the second casing H2 of the electronic device U of the first embodiment are stacked together, only the first radiation element 1, the second radiation element 2 and the grounding element 3 are illustrated in FIG. 6. Specifically, in the first embodiment, the electronic device U includes the first radiation element 1, the second radiation element 2, the grounding element 3 and the feeding element 4; wherein the feeding element 4 is electrically connected between the first radiation element 1 and the grounding element 3, the grounding element 3 is electrically connected to the second radiation element 2, and the first radiation element 1 and the second radiation element 2 are respectively disposed on the first substrate S1 and the second substrate S2. In addition, referring to FIG. 1 and FIG. 6, the orthogonal projection of the second radiation element 2 on the first casing H1 at least partially overlaps with the orthogonal projection of the first radiation element 1 on the first casing H1, and the second radiation element 2 is coupled to the first radiation element 1 and is separate from the first radiation element 1, such that the first radiation element 1 couples to and excites the second radiation element 2. In addition, the first radiation element 1 has a first radiation portion 11 and a feeding portion 10 being electrically connected to the first radiation portion 11, and the feeding element 4 includes a feeding end 41 and a grounding end 42. The feeding end 41 is electrically connected to the feeding portion 10 of the first radiation element 1 and the grounding end 42 is electrically connected to the grounding element 3.

In this embodiment, the first radiation element 1, the second radiation element 2 and the grounding element 3 may be a metal sheet, a metal wire or other electrical conductors that are conductive, the feeding element 4 may be a coaxial cable, and the first substrate S1 and the second substrate S2 may be a flame retardant substrate, a printed circuit board, or a flexible printed circuit board, but the present disclosure is not limited thereto. In addition, it is worth noting that the first radiation element 1, the second radiation element 2 and the grounding element 3 may be formed on the first substrate S1 and the second substrate S2 by laser direct structuring (LDS) technology.

Referring to FIG. 2 to FIG. 5, in the first embodiment, the electronic device U may further include a grounding conductive element C, the grounding conductive element C is disposed on the grounding element 3, and the grounding conductive element C is electrically connected between the second radiation element 2 and the grounding element 3, such that the grounding element 3 is electrically connected to the second radiation element 2 through the grounding conductive element C. In addition, the grounding conductive element C may abut against an abutting spot 200 of the second radiation element 2, such that the grounding element 3 is electrically connected to the second radiation element 2. Specifically, the grounding conductive element C is a conductive elastic metal element, such as a spring or a resilient member, but the present disclosure is not limited thereto. It is worth noting that, in other implementations, the grounding conductive element C may be disposed on the second radiation element 2, and the grounding conductive element C abuts against the grounding element 3 and is electrically connected between the second radiation element 2 and the grounding element 3. Further, the grounding conductive element C may be a protrusion (not shown in the figures) disposed on the second radiation element 2, and the protrusion disposed on the second radiation element 2 may be abutted to the grounding element 3 such that the second radiation element 2 is electrically connected to the grounding element 3. In addition, in another implementation, the grounding conductive element C may be a protrusion (not shown in the figures) disposed on the grounding element 3, and the protrusion disposed on the grounding element 3 may be abutted to the second radiation element 2. The present disclosure is not limited to the specific structure of the grounding conductive element C.

Referring to FIG. 2 to FIG. 6, the specific structure of the first radiation element 1 and the second radiation element 2 is described as follows, and the following description is an example of the use state of the first radiation element 1, the second radiation element 2 and the grounding element 3 when the first casing H1 and the second casing H2 of the electronic device U of the first embodiment are stacked together. Specifically, in the first embodiment, the first radiation element 1 further has a second radiation portion 12 electrically connected to the first radiation portion 11, and the feeding portion 10 is electrically connected between the first radiation portion 11 and the second radiation portion 12. Referring to FIG. 6, the first radiation portion 11 has a first section 111 connected to the feeding portion 10, a second section 112 connected to the first section 111 and bent relative to the first section 111, a third section 113 connected to the second section 112 and bent relative to the second section 112, and a fourth section 114 connected to the third section 113 and bent relative to the third section 113. In addition, the second radiation portion 12 has a fifth section 121 connected to the feeding portion 10, a sixth section 122 connected to the fifth section 121 and bent relative to the fifth section 121. In addition, the second radiation element 2 has a seventh section 21 electrically connected to the grounding element 3 and an eighth section 22 connected to the seventh section 21 and bent relative to the seventh section 21, and the abutting spot 200 of the second radiation element 2 is positioned on the seventh section 21. It should be noted that, the present disclosure is not limited to a specific shape of the first radiation element 1 and the second radiation element 2.

Referring to FIG. 6, the first section 111 may be extended in a first direction (positive Y-direction) relative to the feeding portion 10, the second section 112 may be extended in a second direction (negative X-direction) relative to a junction of the second section 112 and the first section 111, the third section 113 may be extended in a third direction (negative Y-direction) relative to a junction of the third section 113 and the second section 112, and the fourth section 114 may be extended in a fourth direction (positive X-direction) relative to a junction of the fourth section 114 and the third section 113. In addition, the fifth section 121 may be extended in the third direction (negative Y-direction) relative to the feeding portion 10, and the sixth section 122 may be extended in the fourth direction (positive X-direction) relative to a junction of the sixth section 122 and the fifth section 121. Further, the seventh section 21 of the second radiation element 2 may be extended in the third direction (negative Y-direction) relative to a junction (such as an abutting spot 200 of the second radiation element 2) of the seventh section 21 and grounding element 3, and the eighth section 22 may be extended in the fourth direction (positive X-direction) relative to a junction of the eighth section 22 and the seventh section 21. It should be noted that, the aforementioned directional extensions of the sections of the first radiation element 1 and the second radiation element 2 are exemplified, and the present disclosure is not limited thereto.

In the first embodiment, the operating frequency band generated by the first radiation element 1 is greater than the operating frequency band generated by the second radiation element 2. Specifically, the center frequency of the operating frequency band generated by the first radiation element 1 is greater than the center frequency of the operating frequency band generated by the second radiation element 2. In one of the implementations, the first radiation element 1 generates the operating frequency band of between 1710 MHz and 2690 MHz, and the second radiation element 2 generates the operating frequency band of between 698 MHz and 960 MHz, but the present disclosure is not limited thereto. In addition, an operating frequency band generated by the second radiation portion 12 is greater than an operating frequency band generated by the first radiation portion 11. Specifically, a center frequency of the operating frequency band generated by the second radiation portion 12 is greater than a center frequency of the operating frequency band generated by the first radiation portion 11. In one of the implementations, the first radiation portion 11 generates an operating frequency band of between 1710 MHz and 2100 MHz, and the second radiation portion 12 generates an operating frequency band of between 2100 MHz and 2690 MHz, but the present disclosure is not limited thereto.

Referring to FIG. 2 to FIG. 4, in conjunction with FIG. 7, from comparing FIG. 7 with FIG. 2 to FIG. 4, it can be observed that in the implementation of FIG. 7, the first radiation element 1 and the second radiation element 2 are respectively disposed on two opposite surfaces of the same substrate S. Specifically, the substrate S is disposed between the first casing H1 and the second casing H2, and the substrate S has a first surface S101 and a second surface S102 opposite to the first surface S101. The first radiation element 1 and grounding element 3 are disposed on the first surface S101, and the second radiation element 2 is disposed on the second surface S102. It should be noted that, since in the implementation of FIG. 7, the first radiation element 1, the grounding element 3 and the second radiation element 2 are disposed on the same substrate S, the grounding element 3 and the second radiation element 2 may be electrically connected by the grounding conductive element C. The grounding conductive element C may be an electrical conductor in a via hole, which is electrically connected between the grounding element 3 and the second radiation element 2. In addition, it should be noted that, the second casing H2 has at least a non-metal area H20 corresponding to the contours of the second radiation element 2. Further, the orthogonal projection of the second radiation element 2 on the second casing H2 at least partially overlaps with the non-metal area H20. Preferably, in another implementation, the second casing H2 further has a non-metal area (not shown in the figures) corresponding to the contours of the first radiation element 1, and the orthogonal projection of the first radiation element 1 on the second casing H2 at least partially overlaps with the non-metal area (not shown in the figures). It should be noted that, compared to the implementation of FIG. 3, in the implementation of FIG. 7, a non-metal element may be filled in a groove on the second casing H2 so as to seal the groove.

Second Embodiment

Figure 8:
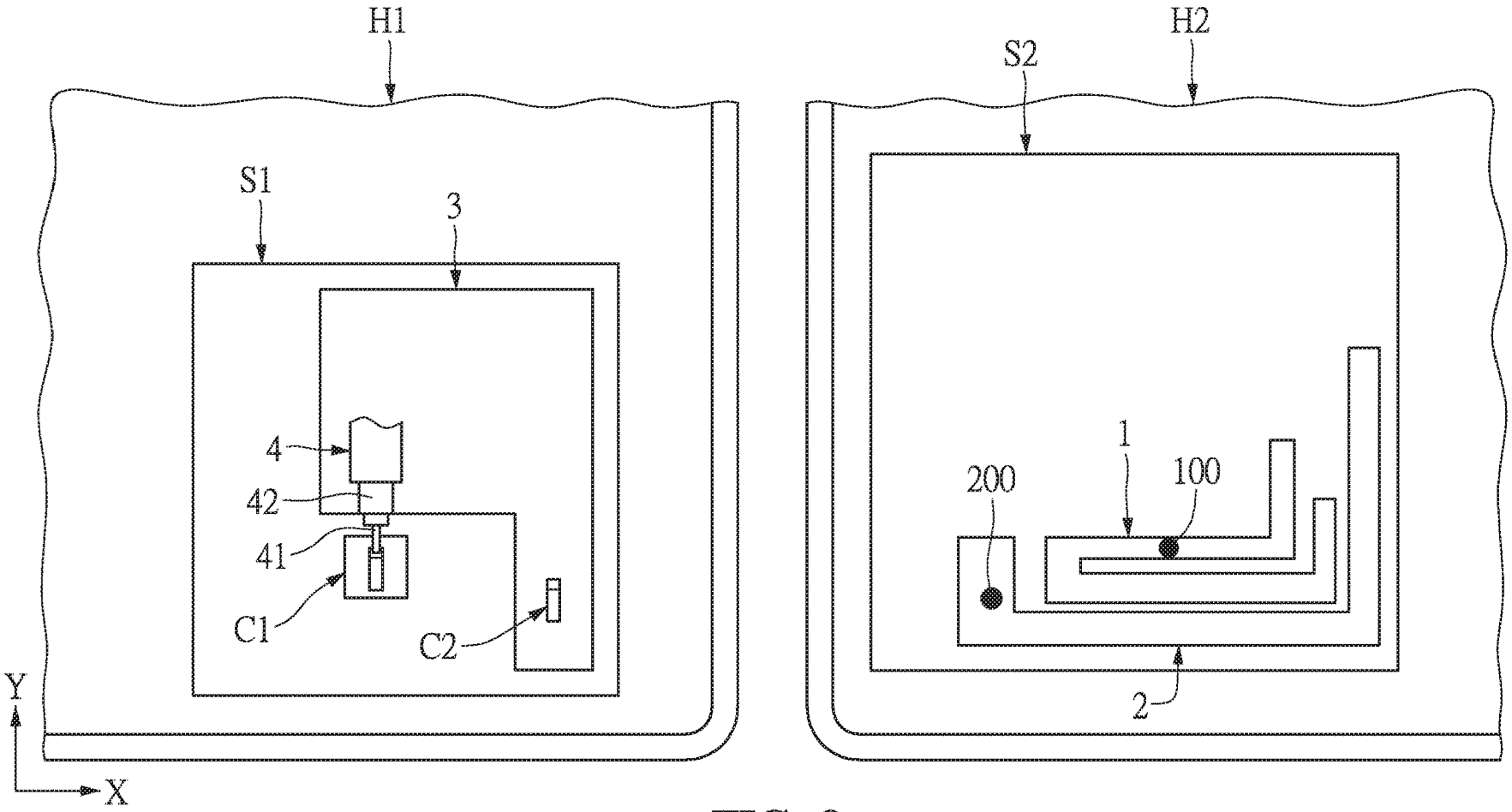
FIG. 8 is an exploded view of an electronic device according to a second embodiment of the present disclosure.
Figure 9:
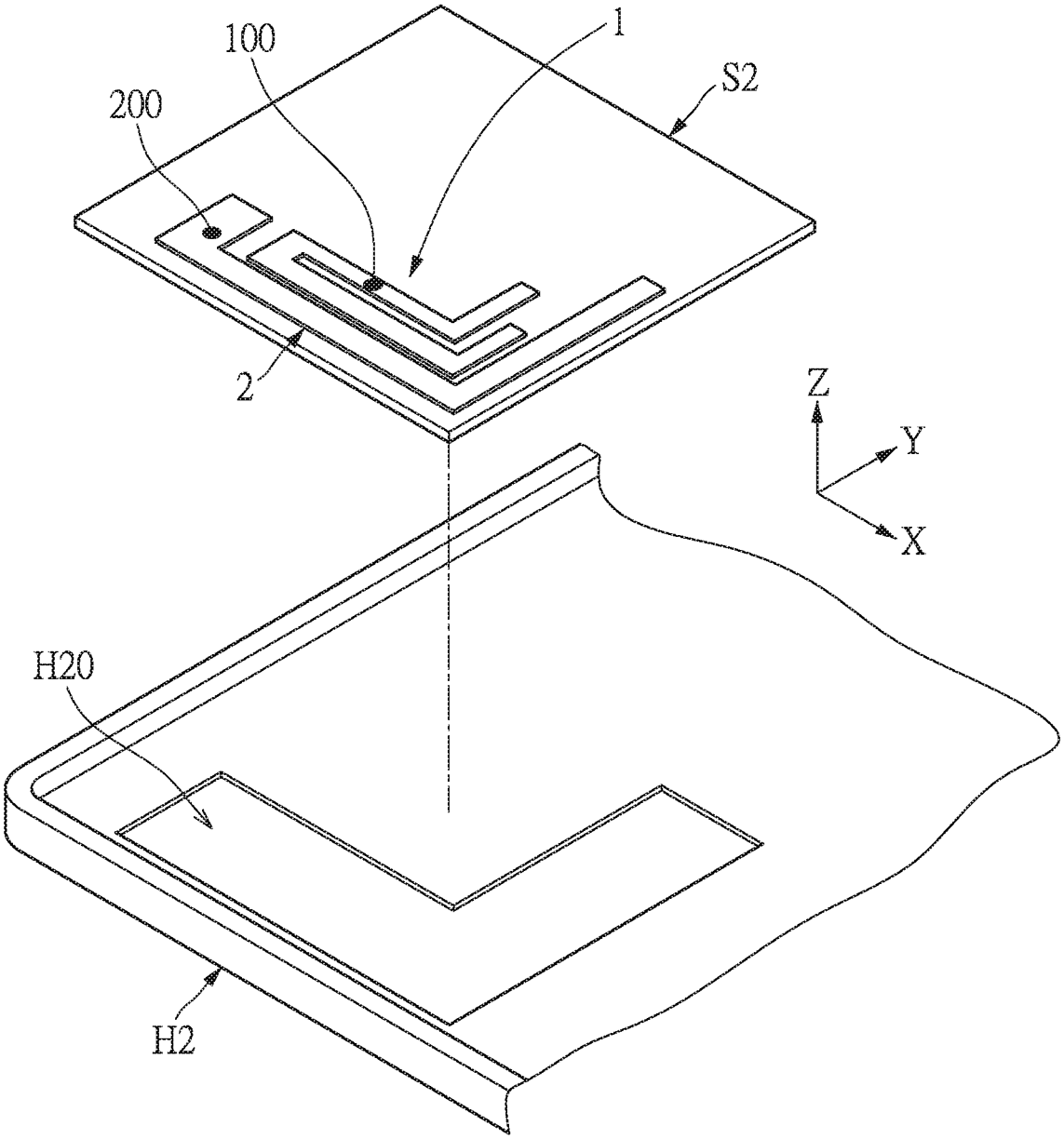
FIG. 9 is an exploded perspective view of a portion of the electronic device according to the second embodiment of the present disclosure.
Figure 10:
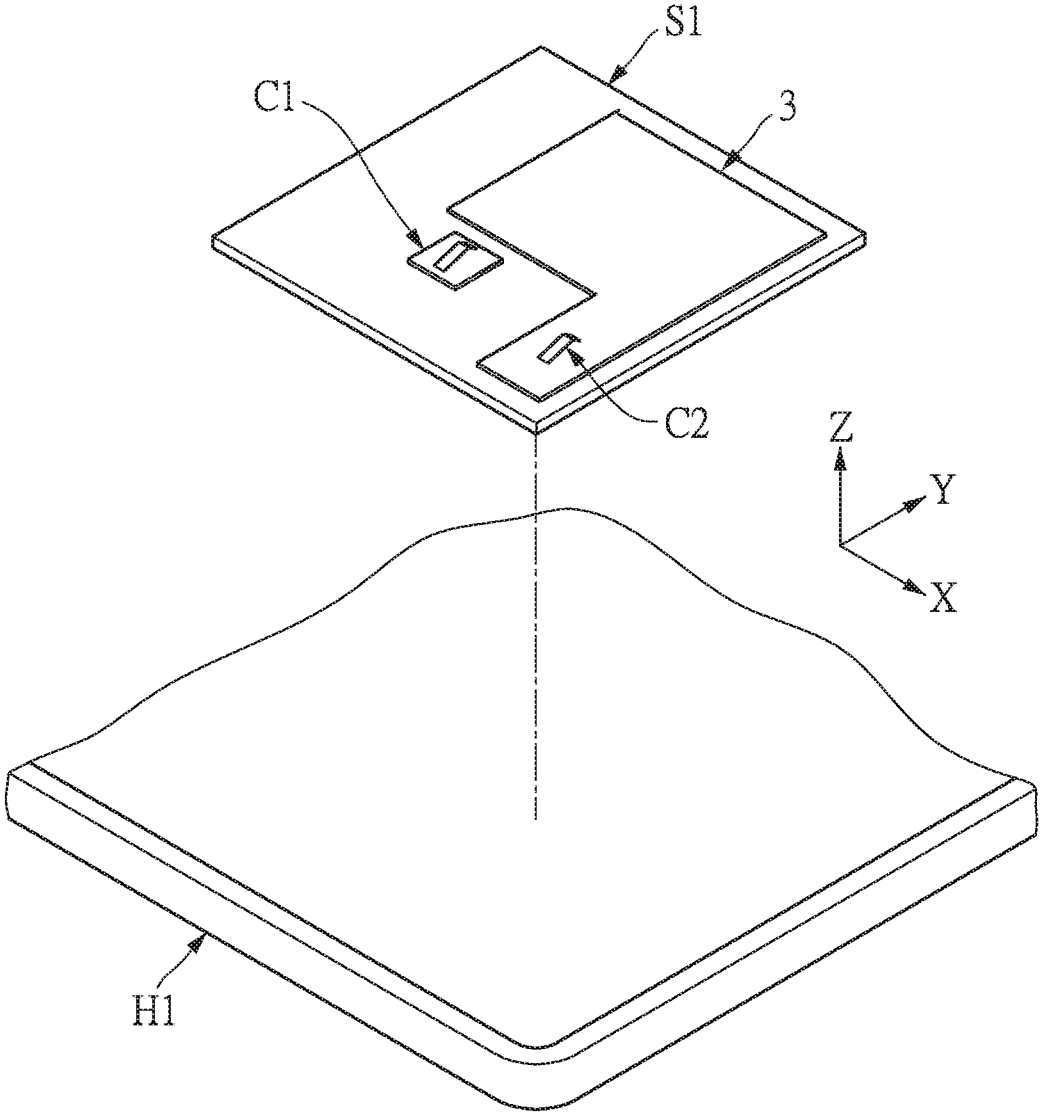
FIG. 10 is an exploded perspective view of another portion of the electronic device according to the second embodiment of the present disclosure.

Firstly, referring to FIG. 8 to FIG. 10, it can be observed from a comparison of FIG. 8 to FIG. 10 and FIG. 2 to FIG. 4 that a structure of the first radiation element 1 and the second radiation element 2 provided in the second embodiment is different from the structure of the first radiation element 1 and the second radiation element 2 provided in the first embodiment. That is, the first radiation element 1 and the second radiation element 2 provided in the second embodiment are disposed on the same surface of the second substrate S2. In addition, it should be noted that, the other structures of the electronic device U provided in the second embodiment are the same as those provided in the aforementioned first embodiment, and will not be reiterated herein.

Specifically, the electronic device U includes a first radiation element 1, a second radiation element 2, a grounding element 3 and a feeding element 4. The first radiation element 1 has a first radiation portion 11 and a feeding portion 10 electrically connected to the first radiation portion 11, the second radiation element 2 is coupled to the first radiation element 1 and is separate from the first radiation element 1, and the grounding element 3 is electrically connected to the second radiation element 2. The feeding element 4 includes a feeding end 41 and a grounding end 42, the feeding end 41 is electrically connected to the feeding portion 10 and the grounding end 42 is electrically connected to the grounding element 3. In addition, the operating frequency band generated by the first radiation element 1 is greater than the operating frequency band generated by the second radiation element 2. Specifically, a center frequency of a first operating frequency band is greater than a center frequency of a second operating frequency band. In one of the implementations, the first radiation element 1 mainly generates an operating frequency band of between 1710 MHz and 2690 MHz, and the second radiation element 2 mainly generates an operating frequency band of between 698 MHz and 960 MHz, but the present disclosure is not limited thereto.

Further, the electronic device U may further include a first substrate S1, a second substrate S2, a first casing H1 and a second casing H2; wherein the first substrate S1 is disposed on the first casing H1, and the second substrate S2 is disposed on the second casing H2. In addition, in the second embodiment, the first radiation element 1 and the second radiation element 2 are disposed on the same surface of the second substrate S2, and the grounding element 3 may be disposed on the first substrate S1. It should be noted that the material of the first casing H1 may be metal, the material of the second casing H2 may also be metal, and when the material of the first casing H1 is metal, the grounding element 3 may be electrically connected to the first casing H1. Further, it should be particularly noted that, the second casing H2 has at least a non-metal area H20 corresponding to the contours of the first radiation element 1 and the second radiation element 2, and the orthogonal projection of the first radiation element 1 and the second radiation element 2 on the second casing H2 at least partially overlaps with the non-metal area H20. Preferably, in one implementation, an area of the orthogonal projection of the first radiation element 1 and the second radiation element 2 on the second casing H2 is less than an area of the non-metal area H20, and the orthogonal projection of the first radiation element 1 and the second radiation element 2 on the second casing H2 completely overlaps on the non-metal area H20. In addition, referring to FIG. 9, the non-metal area H20 may be a groove on the second casing H2, whereas in other implementations the non-metal area H20 may be formed by filling a non-metal element in the groove on the second casing H2, but the present disclosure is not limited in a manner that the non-metal area H20 is formed on the second casing H2.

Figure 11:
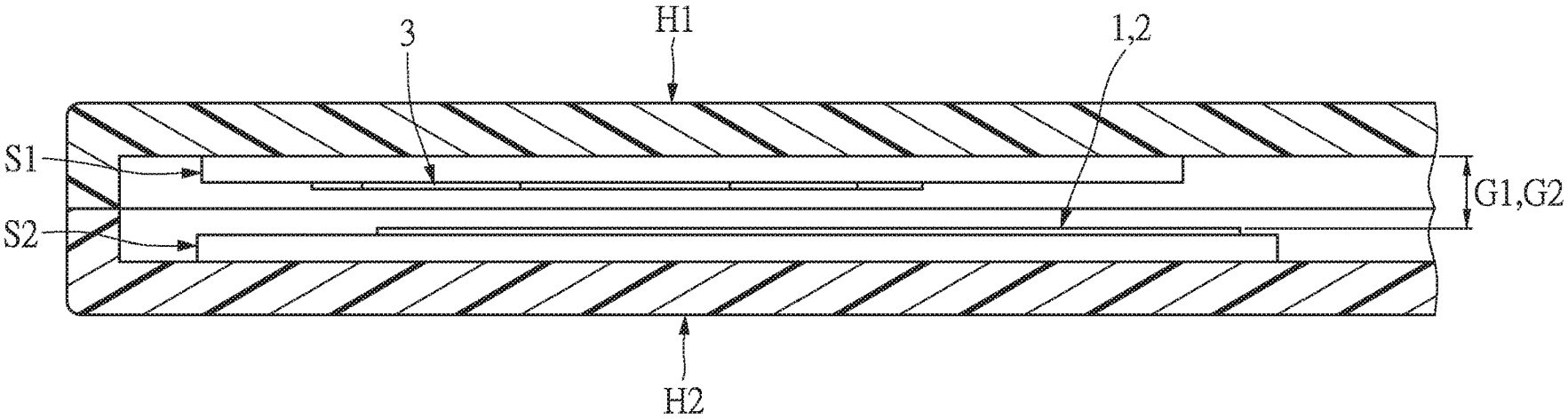
FIG. 11 is a sectional view of another portion of the electronic device according to the second embodiment of the present disclosure.

Further, referring to FIG. 8 to FIG. 10, in conjunction with FIG. 11, the present disclosure is exemplified with the material of the first casing H1 and the second casing H2 being metal, the orthogonal projection of the first radiation element 1 on the first casing H1 at least partially or completely overlapping with a metal area (not labeled in the figures) on the first casing H1, the orthogonal projection of the second radiation element 2 on the first casing H1 at least partially or completely overlapping with a metal area (not labeled in the figures) on the first casing H1, and the orthogonal projections of the first radiation element 1 and the second radiation element 2 on the second casing H2 at least partially overlapping with the non-metal area H20 on the second casing H2. It should be noted that, in other implementations, the orthogonal projection of the second radiation element 2 on the second casing H2 may at least partially overlap with the non-metal area H20 on the second casing H2, and the orthogonal projection of the first radiation element 1 on the second casing H2 does not overlap with the non-metal area H20 on the second casing H2. In other words, in the second embodiment, the non-metal area H20 on the second casing H2 at least partially overlaps with the orthogonal projection of the second radiation element 2 on the second casing H2.

Further, when the first casing H1 and the second casing H2 are stacked together as shown in FIG. 1, the first casing H1 and the second casing H2 may have a distance there-between, and the first substrate S1, the second substrate S2, the first radiation element 1, and the second radiation element 2 are disposed between the first casing H1 and the second casing H2. Further referring to FIG. 11, in the second embodiment, the first radiation element 1 and the second radiation element 2 are disposed on the second substrate S2, so that the first radiation element 1 and the first casing H1 may have a first predetermined distance G1 greater than 5 mm there-between, and the second radiation element 2 and the first casing H1 have a second predetermined distance G2 greater than 5 mm there-between. Since the material of at least one of the first casing H1 and the second casing H2 is metal, a structure of the first radiation element 1 and the first casing H1 having a first predetermined distance G1 and the second radiation element 2 and the first casing H1 having a second predetermined distance G2 may be used to prevent the first casing H1 and/or second casing H2 from negatively affecting the radiation efficiency of the first radiation element 1 and the second radiation element 2.

Referring to FIG. 8 to FIG. 10, in the second embodiment, since the first radiation element 1 and the second radiation element 2 are disposed on the second substrate S2, and the grounding element 3 is disposed on the first substrate S1, the electronic device U of the second embodiment can further include a first conductive element C1 and a second conductive element C2 so as to use the first conductive element C1 for signal feeding and the second conductive element C2 for grounding. Specifically, the first conductive element C1 and the second conductive element C2 are disposed on the first substrate S1, and the first conductive element C1 is separate and insulated from the second conductive element C2. The first conductive element C1 is electrically connected between the feeding end 41 of the feeding element 4 and the first radiation element 1, and the second conductive element C2 is electrically connected between the grounding element 3 and the second radiation element 2. In addition, the feeding end 41 of the feeding element 4 is electrically connected to the first conductive element C1, and the first conductive element C1 includes a conductive elastic metal element (not labeled in the figures) that abuts against an abutting spot 100 on the first radiation element 1. The conductive elastic metal element of the first conductive element C1 is abutted to the abutting spot 100 on the first radiation element 1, such that the feeding end 41 is electrically connected to the feeding portion 10 of the first radiation element 1. In addition, the second conductive element C2 is disposed on the grounding element 3 and the second conductive element C2 is electrically connected between the second radiation element 2 and the grounding element 3, such that the grounding element 3 is electrically connected to the second radiation element 2 through the second conductive element C2. In addition, the second conductive element C2 may abut against an abutting spot 200 of the second radiation element 2 such that the grounding element 3 is electrically connected to the second radiation element 2. Further, the second conductive element C2 may be a conductive elastic metal element, such as a spring or a resilient member. In addition, in the second embodiment, the implementation of the first conductive element C1 and the second conductive element C2 being disposed on the first substrate S1, and the first conductive element C1 being used for feeding signal to the first radiation element 1, and the second conductive element C2 being used for grounding the second radiation element 2 is exemplified. In other implementations, the first conductive element C1 and the second conductive element C2 may be disposed on the second substrate S2, where the first conductive element C1 may be disposed on the first radiation element 1 and the second conductive element C2 may be disposed on the second radiation element 2. The present disclosure is not limited to the specific structure of the first conductive element C1 and the second conductive element C2.

Figure 12:
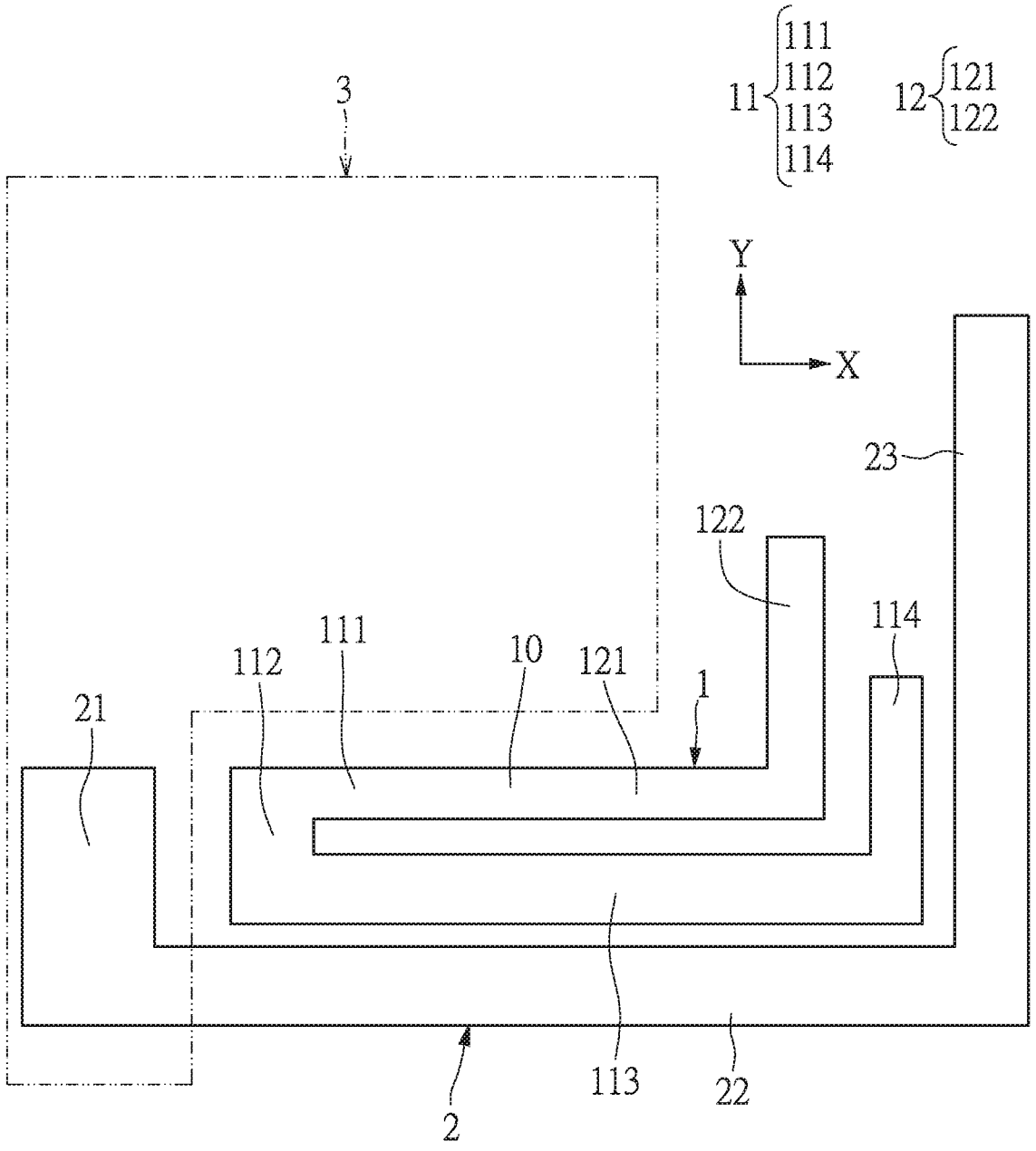
FIG. 12 is a schematic view showing a first radiation element, a second radiation element, and a grounding element in a state of use, with a first casing and a second casing of the electronic device being stacked together, according to the second embodiment of the present disclosure.

Reference is made to FIG. 8 to FIG. 10 again, in conjunction with FIG. 12, where the specific structure of the first radiation element 1 and the second radiation element 2 is described as follows, and the following description is an example of the use state of the first radiation element 1, the second radiation element 2 and the grounding element 3 when the first casing H1 and the second casing H2 of the electronic device U of the first embodiment are stacked together. Specifically, in the second embodiment, the first radiation element 1 further has a second radiation portion 12 electrically connected to the first radiation portion 11, and the feeding portion 10 is electrically connected between the first radiation portion 11 and the second radiation portion 12. Referring to FIG. 12, the first radiation portion 11 has a first section 111 connected to the feeding portion 10, a second section 112 connected to the first section 111 and bent relative to the first section 111, a third section 113 connected to the second section 112 and bent relative to the second section 112, and a fourth section 114 connected to the third section 113 and bent relative to the third section 113. In addition, the second radiation portion 12 has a fifth section 121 connected to the feeding portion 10, a sixth section 122 connected to the fifth section 121 and bent relative to the fifth section 121. In addition, the second radiation element 2 has a seventh section 21 electrically connected to the grounding element 3, an eighth section 22 connected to the seventh section 21 and bent relative to the seventh section 21, a ninth section 23 connected to the eighth section 22 and bent relative to the eighth section 22, and the abutting spot 200 of the second radiation element 2 is positioned on the seventh section 21. It should be noted that, the present disclosure is not limited to a specific shape of the first radiation element 1 and the second radiation element 2. In addition, the aforementioned directional extensions of the sections of the first radiation element 1 and the second radiation element 2 shown in FIG. 12 are exemplified, and the present disclosure is not limited thereto.

In the second embodiment, the operating frequency band generated by the first radiation element 1 is greater than the operating frequency band generated by the second radiation element 2. Specifically, the center frequency of the operating frequency band generated by the first radiation element 1 is greater than the center frequency of the operating frequency band generated by the second radiation element 2. In one of the implementations, the first radiation element 1 generates the operating frequency band of between 1710 MHz and 2690 MHz, and the second radiation element 2 generates the operating frequency band of between 698 MHz and 960 MHz, but the present disclosure is not limited thereto. In addition, an operating frequency band generated by the second radiation portion 12 is greater than an operating frequency band generated by the first radiation portion 11. Specifically, a center frequency of the operating frequency band generated by the second radiation portion 12 is greater than a center frequency of the operating frequency band generated by the first radiation portion 11. In one of the implementations, the first radiation portion 11 generates an operating frequency band of between 1710 MHz and 2100 MHz, and the second radiation portion 12 generates an operating frequency band of between 2100 MHz and 2690 MHz, but the present disclosure is not limited thereto.

In conclusion, by virtue of "the second radiation element 2 is coupled to the first radiation element 1 and is separate from the first radiation element 1", an electronic device U of the present disclosure uses a first radiation element 1 and a second radiation element 2 to respectively generate two different operating frequency bands, and the operating frequency band generated by the first radiation element 1 is greater than the operating frequency band generated by the second radiation element 2.

Furthermore, an antenna module A of the electronic device U of the present disclosure is preferably applied to a structure where the material of a first casing H1 is metal and the material of a second casing H2 is non-metal, or a structure where the material of the first casing H1 and the second casing H2 are both metal. In other words, the present disclosure may be applied to a structure where the material of at least one of the first casing H1 and the second casing H2 is metal. In addition, the present disclosure prevents the first casing H1 and/or second casing H2 from negatively affecting the radiation efficiency of the first radiation element 1 and the second radiation element 2 by using the technical solutions of the first radiation element 1 and the first casing H1 having a first predetermined distance G1 greater than 0.1 mm there-between, and the second radiation element 2 and the first casing H1 having a second predetermined distance G2 greater than 5 mm there-between.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. An electronic device, comprising:

a first radiation element having a first radiation portion and a feeding portion electrically connected to the first radiation portion;

a second radiation element wirelessly coupled to the first radiation element and being separate from the first radiation element, wherein the first radiation element excites the second radiation element;

a grounding element electrically connected to the second radiation element;

a feeding element including a feeding end and a grounding end, wherein the feeding end is electrically connected to the feeding portion, and the grounding end is electrically connected to the grounding element and an operating frequency band generated by the first radiation element is greater than an operating frequency band generated by the second radiation element;

a first substrate;

a second substrate;

a first casing; and a second casing;

wherein the first substrate is disposed on the first casing, and the second substrate is disposed on the second casing, the second casing having a non-metal area corresponding to the second radiation element; wherein the first radiation element is disposed on the first substrate, the second radiation element is disposed on the second substrate, the first substrate and the second substrate are disposed between the first casing and the second casing, and an orthogonal projection of the second radiation element on the second casing at least partially overlaps with the non-metal area; and wherein the first casing and the second casing have a distance there-between, and the material of the first casing and the second casing is metal.

2. The electronic device according to claim 1, further comprising:

a grounding conductive element; wherein the grounding conductive element is electrically connected between the second radiation element and the grounding element.

3. The electronic device according to claim 2, wherein the grounding conductive element is an elastic metal element.

4. The electronic device according to claim 1, wherein the orthogonal projection of the second radiation element on the first casing at least partially overlaps with the orthogonal projection of the first radiation element on the first casing.

5. The electronic device according to claim 1, wherein the first radiation element generates an operating frequency band between 1710 MHz and 2690 MHz, and the second radiation element generates an operating frequency band between 698 MHz and 960 MHz.

6. The electronic device according to claim 1, wherein the first radiation element further has a second radiation portion, and the feeding portion is electrically connected between the first radiation portion and the second radiation portion, and the operating frequency band generated by the second radiation portion is greater than the operating frequency band generated by the first radiation portion.

7. The electronic device according to claim 1, wherein the first radiation element and the first casing have a first predetermined distance greater than 0.1 mm there-between, and the second radiation element and the first casing have a second predetermined distance greater than 5 mm there-between.

8. An electronic device, comprising:

a first radiation element having a first radiation portion and a feeding portion electrically connected to the first radiation portion;

a second radiation element wirelessly coupled to the first radiation element and being separate from the first radiation element, wherein the first radiation element excites the second radiation element;

a grounding element electrically connected to the second radiation element;

a feeding element including a feeding end and a grounding end, wherein the feeding end is electrically connected to the feeding portion, and the grounding end is electrically connected to the grounding element, and an operating frequency band generated by the first radiation element is greater than an operating frequency band generated by the second radiation element;

a substrate;

a first casing; and a second casing;

wherein the substrate is disposed between the first casing and the second casing, the substrate includes a first surface and a second surface opposite to the first surface, the first radiation element is disposed on the first surface, and the second radiation element is disposed on the second surface, the first radiation element being disposed adjacent to the first casing, and the second radiation element being disposed adjacent to the second casing; and wherein the second casing has a non-metal area corresponding to the second radiation element, and the orthogonal projection of the second radiation element on the second casing at least partially overlaps with the non-metal area.

9. An electronic device, comprising:

a first radiation element having a first radiation portion and a feeding portion electrically connected to the first radiation portion;

a second radiation element wirelessly coupled to the first radiation element and being separate from the first radiation element, wherein the first radiation element excites the second radiation element;

a grounding element electrically connected to the second radiation element;

a feeding element including a feeding end and a grounding end, wherein the feeding end is electrically connected to the feeding portion, and the grounding end is electrically connected to the grounding element, and an operating frequency band generated by the first radiation element is greater than an operating frequency band generated by the second radiation element;

a first casing; and a second casing;

wherein the first radiation element is disposed adjacent to the first casing, and the second radiation element is disposed adjacent to the second casing; and wherein the second casing has a non-metal area corresponding to the second radiation element, and the orthogonal projection of the second radiation element on the second casing at least partially overlaps with the non-metal area.

10. An electronic device, comprising:

a first radiation element having a first radiation portion and a feeding portion electrically connected to the first radiation portion;

a second radiation element wirelessly coupled to the first radiation element and being separate from the first radiation element, wherein the first radiation element excites the second radiation element;

a grounding element electrically connected to the second radiation element;

a feeding element including a feeding end and a grounding end, wherein the feeding end is electrically connected to the feeding portion, and the grounding end is electrically connected to the grounding element, and an operating frequency band generated by the first radiation element is greater than an operating frequency band generated by the second radiation element;

a first substrate;

a second substrate;

a first casing; and a second casing;

wherein the first substrate is disposed on the first casing, and the second substrate is disposed on the second casing; wherein the first radiation element and the second radiation element are disposed on the second substrate, the second casing has a non-metal area corresponding to the second radiation element, and the orthogonal projection of the first radiation element and the second radiation element on the second casing at least partially overlaps with the non-metal area; and wherein the material of the first casing and the second casing is metal.

11. The electronic device according to claim 10, further comprising: a first conductive element and a second conductive element; wherein the first conductive element and the second conductive element are disposed on the first substrate, the first conductive element is electrically connected between the feeding end and the first radiation element, and the second conductive element is electrically connected between the grounding element and the second radiation element.

12. The electronic device according to claim 10, wherein the first radiation element generates an operating frequency band between 1710 MHz and 2690 MHz, and the second radiation element generates an operating frequency band between 698 MHz and 960 MHz.

13. The electronic device according to claim 10, wherein the first radiation element further has a second radiation portion, the feeding portion is electrically connected between the first radiation portion and the second radiation portion, and the operating frequency band generated by the second radiation portion is greater than the operating frequency band generated by the first radiation portion.

14. The electronic device according to claim 10, wherein the first radiation element and the first casing have a first predetermined distance greater than 0.1 mm there-between, and the second radiation element and the first casing have a second predetermined distance greater than 5 mm there-between.

* * * * *